US011630406B2

(12) United States Patent
Onishi

(10) Patent No.: US 11,630,406 B2
(45) Date of Patent: Apr. 18, 2023

(54) FIXING DEVICE AND IMAGE FORMING APPARATUS

(71) Applicant: KYOCERA Document Solutions Inc., Osaka (JP)

(72) Inventor: Shota Onishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/488,993

(22) Filed: Sep. 29, 2021

(65) Prior Publication Data

US 2022/0100133 A1 Mar. 31, 2022

(30) Foreign Application Priority Data

Sep. 30, 2020 (JP) ..... JP2020-165052

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2053; G03G 2215/2003
See application file for complete search history.

(56) References Cited

U.S. PATENT DOCUMENTS 6,390,683 B1 5/2002 Hirose et al.
2018/0150000 A1* 5/2018 Takagi ..... F16C 13/02

FOREIGN PATENT DOCUMENTS

JP H06-337608 A 12/1994
JP 2001-056020 A 2/2001
JP 2010-224331 A 10/2010

* cited by examiner

*Primary Examiner* — Thomas S Giampaolo, II
(74) *Attorney, Agent, or Firm* — Studebaker & Brackett PC

(57) ABSTRACT

A fixing device includes a heating roller, a pressing roller, a heating part, a heat insulating member and a bearing. The pressing roller holds a sheet with the heating roller. The heating part heats the heating roller. The heat insulating member is fitted on an end portion in an axial direction of the heating roller, has a heat-resistance to heat applied from the heating roller and has an inclined shape in which an outer diameter becomes small toward an inside in the axial direction of the heating roller. The bearing supports the heating roller through the heat insulating member.

8 Claims, 11 Drawing Sheets

FIXING DEVICE AND IMAGE FORMING APPARATUS

INCORPORATION BY REFERENCE

This application is based on and claims the benefit of priority from Japanese patent application No. 2020-165052 filed on Sep. 30, 2020, which is incorporated by reference in its entirety.

BACKGROUND

The present disclosure relates to a fixing device which fixes a toner on a sheet and an image forming apparatus including the fixing device.

In an electrophotographic type image forming apparatus, as an example of a fixing device which fixes a toner on a sheet, a fixing device provided with a cylindrical heating roller is known. The heating roller is supported by a housing with bearings. Such a configuration causes a problem that power consumption increases because of heat escaping through the bearings. Further, there is a problem that the bearings are thermally expanded owing to the heat escaping from the fixing roller to reduce rotational accuracy.

Therefore, conventionally, a heat transfer from the heating roller to the bearings is suppressed by providing a heat-resistant heat insulating member between the shaft of the heating roller and the bearings. FIG. 10 is a sectional view showing one axial end portion of the heating roller 101 of the conventional fixing device 100. FIG. 11 is a perspective view showing a conventional heat insulating member 105. The heating roller 101 is formed in a cylindrical shape using metal and is heated by a heater (not shown). The pressure roller 102 includes a core bar and an elastic layer made of rubber or the like. The bearing 103 is a ball bearing and is fixed to the housing 104. The heat insulating member 105 is formed in a cylindrical shape using heat-resistant resin, is provided between the inner ring of the bearing 103 and the heating roller 101, and rotates following the heating roller 101. The heat insulating member 105 is provided with a slit 106 for absorbing thermal expansion in the circumferential direction.

However, the heating roller 101 thermally expands in the radial direction R and the axial direction A. On the other hand, since the bearing 103 is fixed to the housing 104, its position does not change, and since the bearing 103 is insulated by the heat insulating member 105, its thermal expansion is negligibly small. Therefore, a compressive stress $\sigma$ in the radial direction R and a shearing stress $\tau$ in the axial direction A are generated in the heat insulating member 105, and a resistance to rotation of the bearing 103 increases. Further, since the heating roller 101 is applied with a load F from the pressure roller 102, it rotates in a posture of being slightly bent in an arc shape. Therefore, the compressive stress $\sigma$ and the shearing stress $\tau$ of the heat insulating member 105 increase as the distance from the pressure roller 102 increases. As a result, the slit 106 deforms periodically such that the width of the slit 106 becomes wider as the distance from the pressure roller 102 increases, and the width of the slit 106 becomes narrower as the distance from the pressure roller 102 decreases. Then, failure such as vibration, abnormal noise, slipping and uneven wear may occur.

Therefore, measures for suppressing such a failure have been studied. For example, there is a case where the heat insulating sleeve has a slit dividing the sleeve at one position in the circumferential direction, and the abutment portions on both sides of the slit are formed so as to overlap each other in the axial direction. Further, there is a configuration in which a first bush and a second bush disposed between both axial end portions of the first bearing and the roller shaft at predetermined intervals in the axial direction are provided, a part of the outer circumferential surface of the second bush is formed in a tapered shape from the outside to the inside of the first bearing, and the second bush is biased from the outside to the inside of the first bearing by a coil spring. Further, there is a configuration provided with heat insulating bushes taper-fitting each other and a compression coil spring biasing the heat insulating bushes in the axial direction of the roller.

However, in the above configurations, it is not possible to suppress stress concentration on the heat insulating member.

SUMMARY

In accordance with an aspect of the present disclosure, a fixing device includes a heating roller, a pressing roller, a heating part, a heat insulating member and a bearing. The pressing roller holds a sheet with the heating roller. The heating part heats the heating roller. The heat insulating member is fitted on an end portion in an axial direction of the heating roller, has a heat-resistance to heat applied from the heating roller and has an inclined shape in which an outer diameter becomes small toward an inside in the axial direction of the heating roller. The bearing supports the heating roller through the heat insulating member.

In accordance with an aspect of the present disclosure, an image forming apparatus includes an image forming device which forms a toner image on a sheet, and the fixing device which fixes the toner image on the sheet.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Hereinafter, with reference the attached drawings, a fixing device 7 and a printer 1 (an example of an image forming apparatus) according to one embodiment of the present disclosure will be described.

Figure 1:
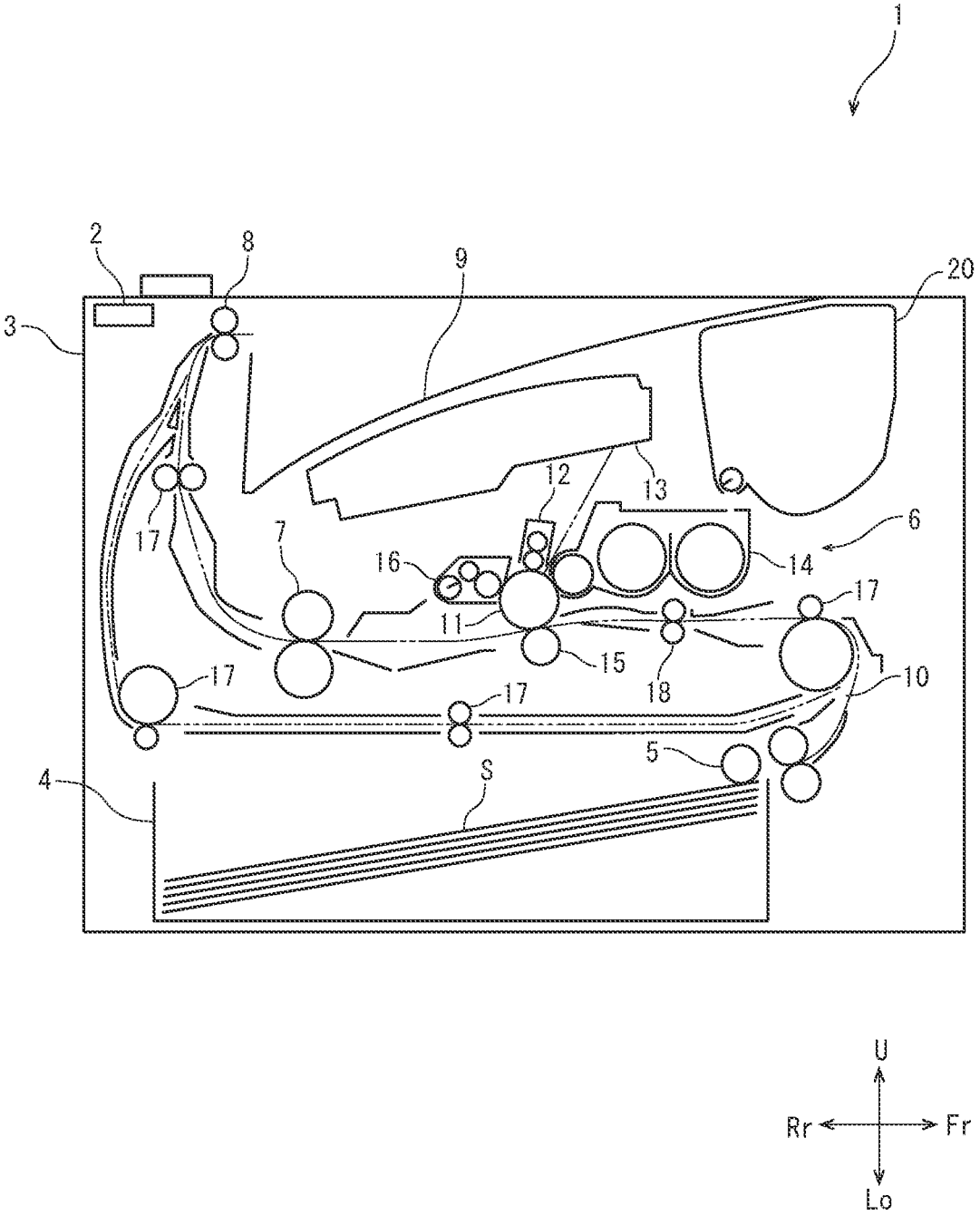
FIG. 1 is a left side view schematically showing an inner structure of a printer according to one embodiment of the present disclosure.

First, an entire structure of the printer 1 will be described. FIG. 1 is a left side view schematically showing an inner structure of the printer 1. Hereinafter, the front side Fr of the paper surface on which FIG. 1 is drawn is defined as a front side of the printer 1, and the right-and-left direction is described based on the direction in which the printer 1 is viewed from the front side. In each drawing, U, Lo, L, R, Fr and Rr indicate upper, lower, left, right, front and rear, respectively.

The printer 1 includes a rectangular parallelepiped main body housing 3. In the lower portion of the main body housing 3, a sheet feeding cassette 4 in which a sheet S is placed and a sheet feeding roller 5 which feeds the sheet S from the sheet feeding cassette 4 are provided. Above the sheet feeding cassette 4, an image forming device 6 which forms a toner image on the sheet S in an electrophotographic manner and a fixing device 7 which fixes the toner image on the sheet S are provided. In the upper portion of the main body housing 3, a discharge rollers pair 8 which discharges the sheet S on which the toner image is fixed and a discharge tray 9 on which the discharged sheet S is stacked are provided.

The image forming device 6 includes: a photosensitive drum 11 whose potential is changed by irradiation of light; a charging device 12 which charges the photosensitive drum 11 by discharging; an exposure device 13 which emits laser light according to image data; a development device 14 which supplies a toner to the photosensitive drum 11; a transfer roller 15 which generates a transfer bias; and a cleaning device 16 which removes the toner remaining on the photosensitive drum 11. A toner container 20 which supplies the toner to the development device 14 is connected to the development device 14.

Inside the main body housing 3, a conveyance path 10 is provided from the sheet feeding roller 5 to the discharge rollers pair 8 via the image forming device 6 and the fixing device 7. On the conveyance path 10, a plurality of conveyance rollers pairs 17 which conveys the sheet S is provided. On the upstream side of the image forming device 6 in the conveyance direction, a registration rollers pair 18 is provided.

Each part of the printer 1 is controlled by a controller 2. The controller 2 includes a processor and a memory. The processor is, for example, a CPU (central processing unit). The memory includes a storage medium such as ROM (Read Only Memory), RAM (Random Access Memory), EEPROM (Electrically Erasable Programmable Read Only Memory), etc. The processor reads and executes control program stored in the memory, and performs various processing. The controller 2 may be implemented by an integrated circuit that does not use software.

Next, an outline of the image forming operation of the printer 1 will be described. When a printing job is input to the printer 1 from an external computer or the like, the sheet feeding roller 5 feeds the sheet S from the sheet feeding cassette 4 to the conveyance path 10, the registration rollers pair 18 whose rotation is stopped corrects a skew of the sheet S, and the registration rollers pair 18 feeds the sheet S to the image forming device 6 at a predetermined timing. In the image forming device 6, the charging device 12 charges the photosensitive drum 11 to a predetermined potential, the exposure device 13 writes an electrostatic latent image on the photosensitive drum 11, the development device 14 develops the electrostatic latent image using the toner supplied from the toner container 20, and the transfer roller 15 transfers the toner image to the sheet S. Subsequently, the fixing device 7 fuses the toner image while holding and conveying the sheet S to fix the toner image on the sheet S, and the discharge rollers pair 8 discharges the sheet S to the discharge tray 9. The cleaning device 16 removes the toner remaining on the photosensitive drum 11.

Figure 2:
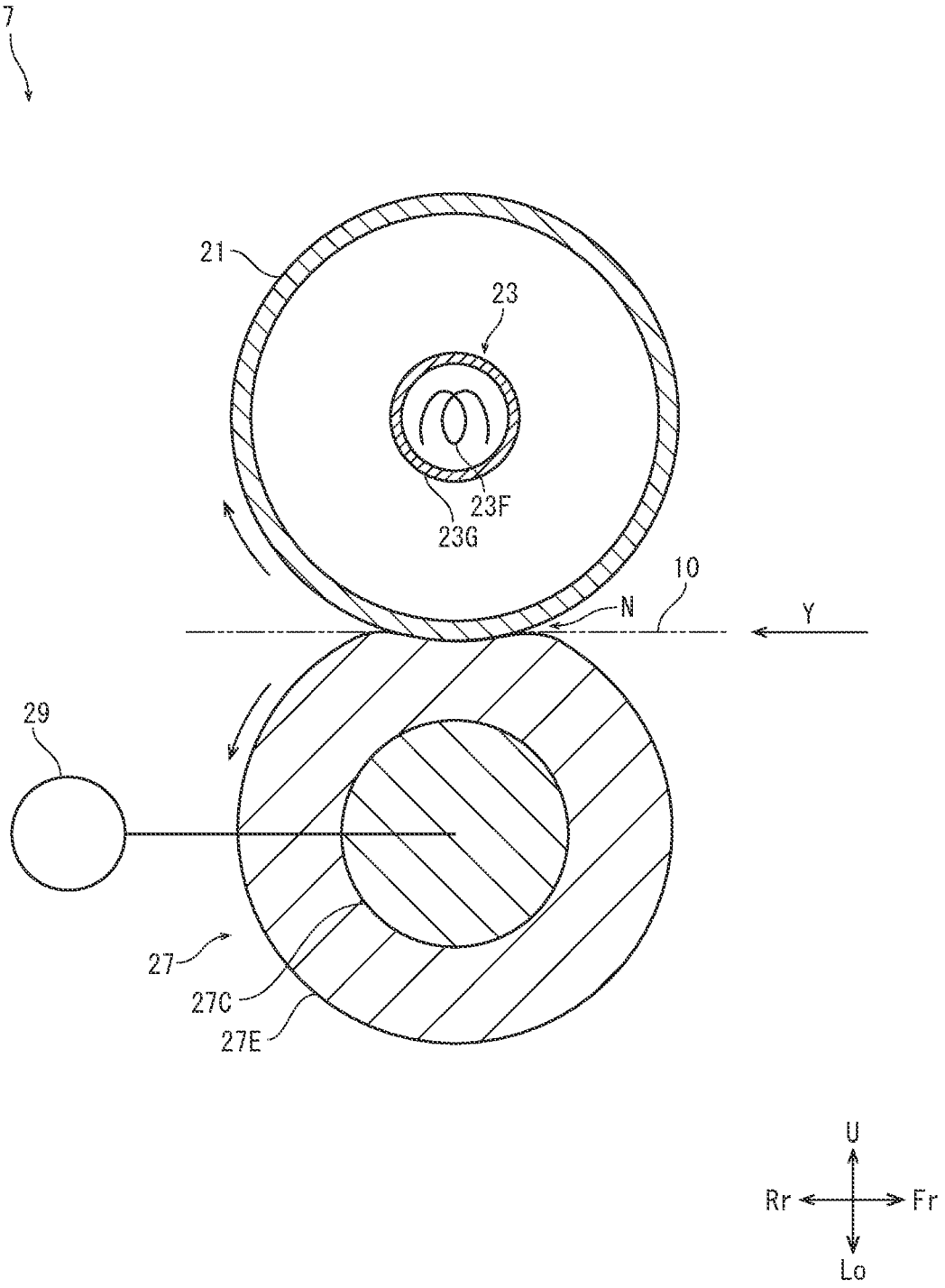
FIG. 2 is a sectional view showing a fixing device according to the embodiment of the present disclosure.
Figure 3:
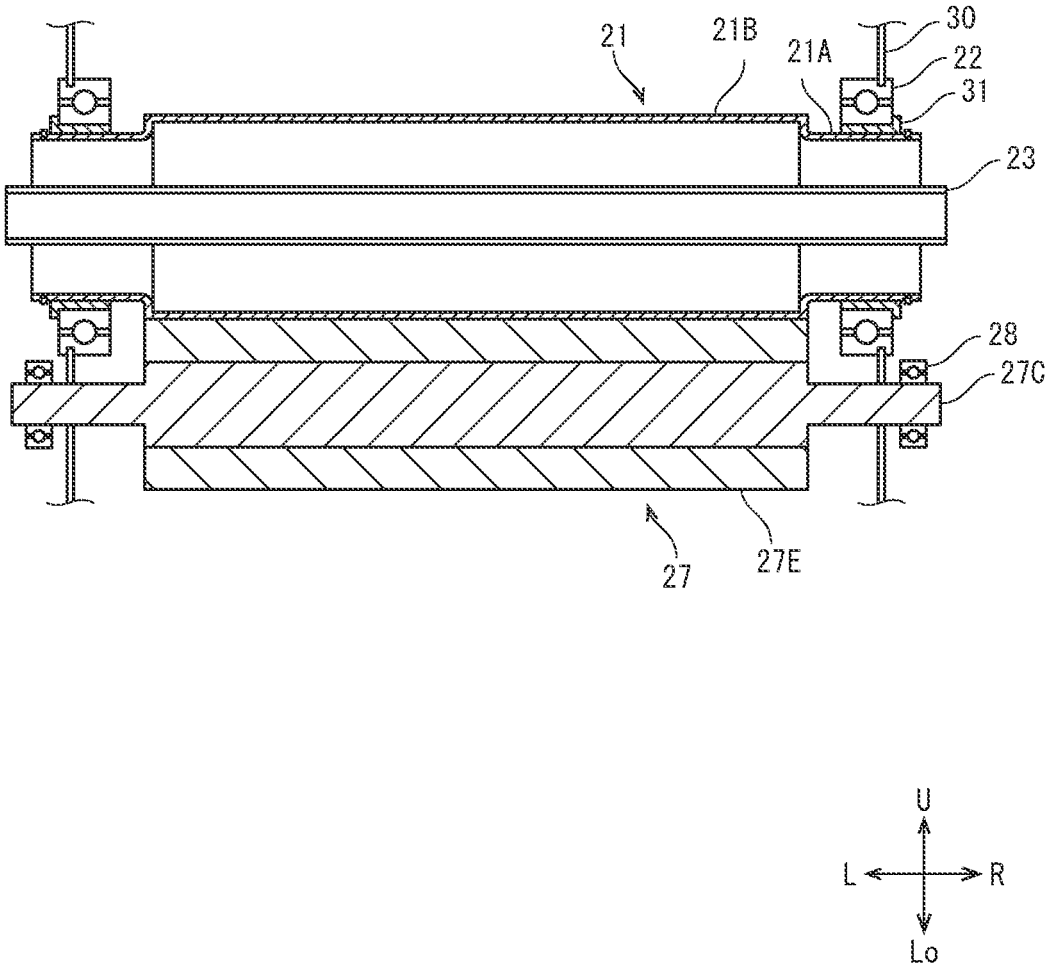
FIG. 3 is a sectional view showing the fixing device according to the embodiment of the present disclosure.
Figure 4:
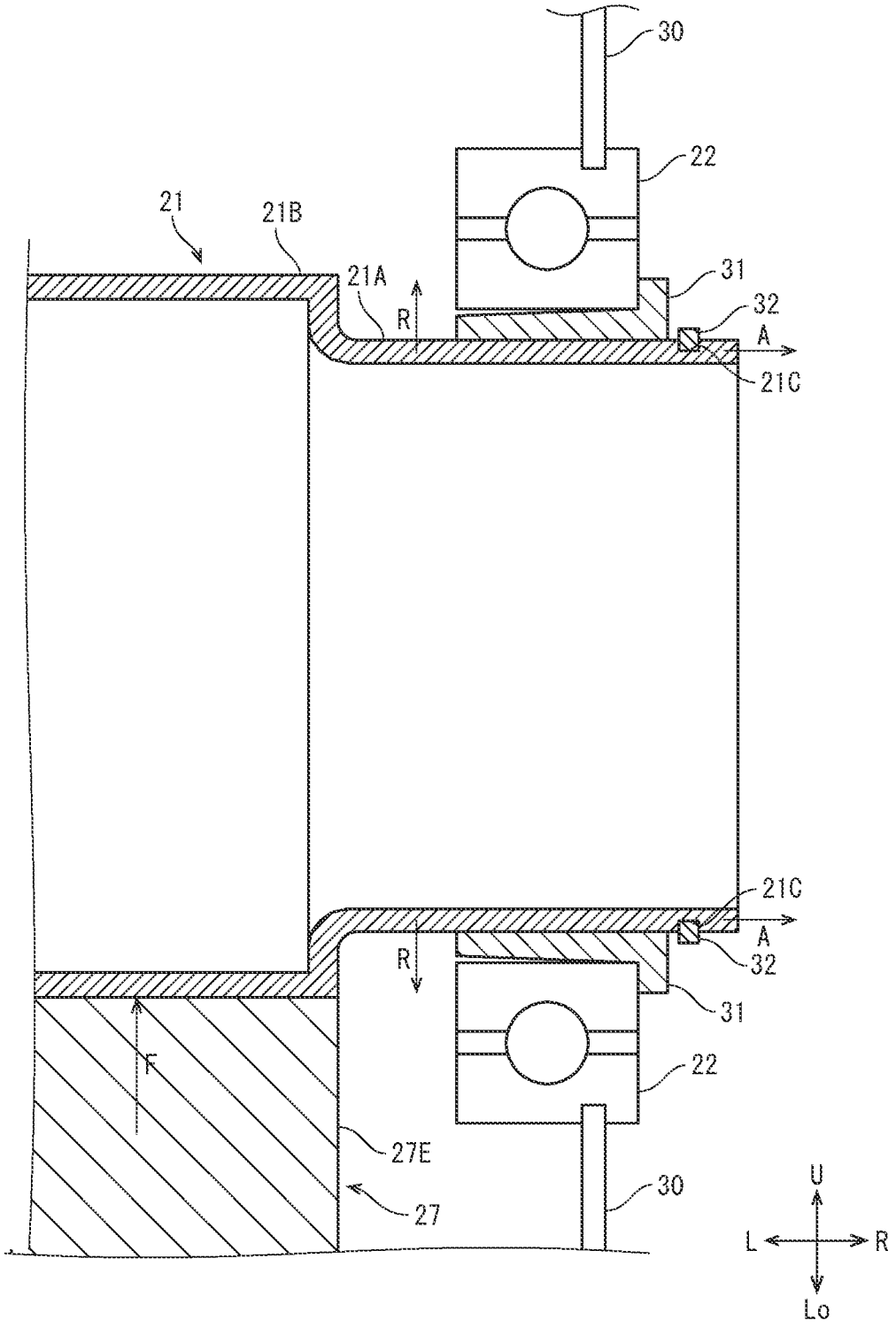
FIG. 4 is a sectional view showing an axial end portion of the fixing device according to the embodiment of the present disclosure.
Figure 5A:
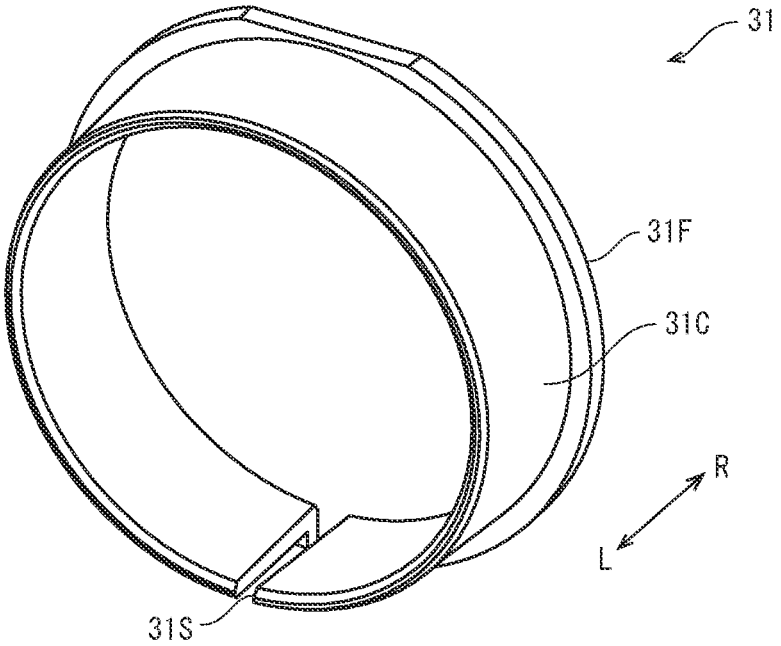
FIG. 5A is a perspective view showing a heat insulating member according to the embodiment of the present disclosure.
Figure 5B:
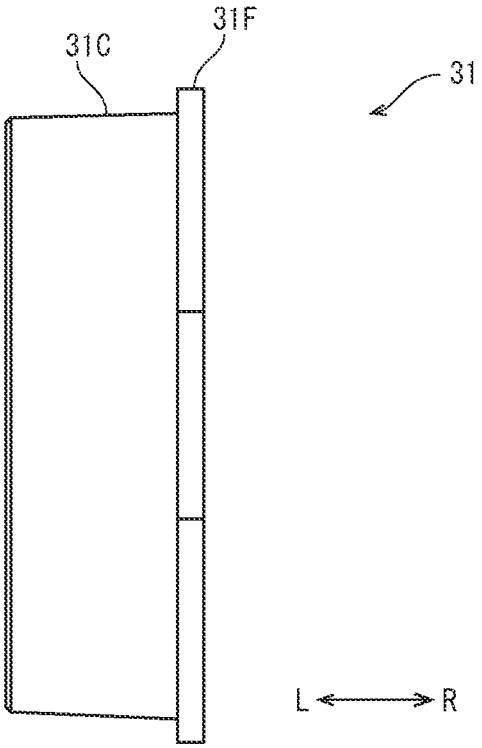
FIG. 5B is a plan view showing the heat insulating member according to the embodiment of the present disclosure.
Figure 6:
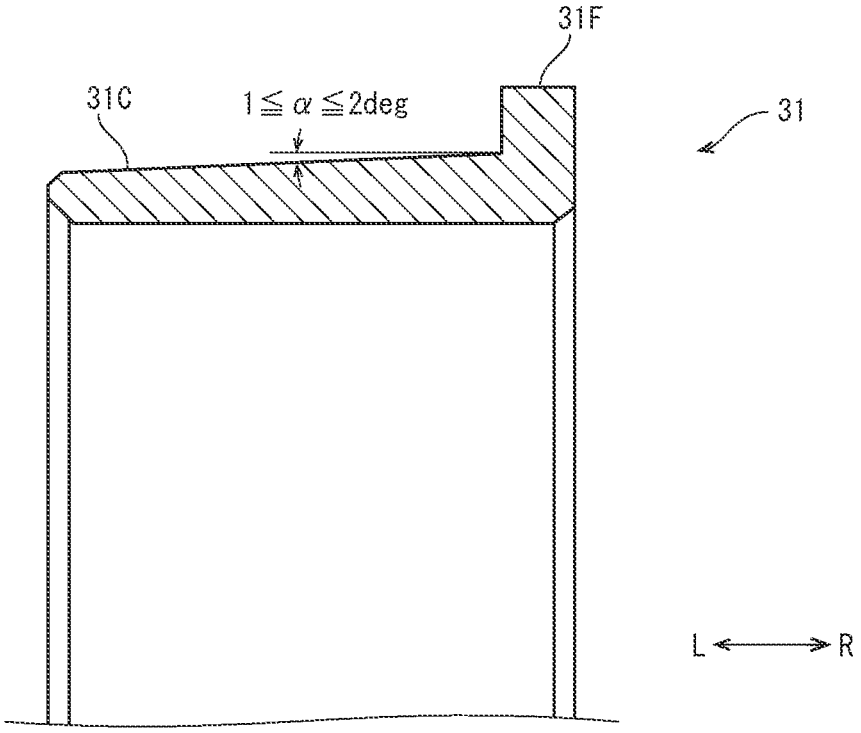
FIG. 6 is a sectional view showing the heat insulating member according to the embodiment of the present disclosure.

[Fixing Device] Next, a structure of the fixing device 7 will be described in detail. FIG. 2 and FIG. 3 are sectional views showing the fixing device 7. FIG. 4 is a sectional view showing an axial end portion of the fixing device 7. FIG. 5A is a perspective view showing a heat insulating member 31. FIG. 5B is a plan view showing the heat insulating member 31. FIG. 6 is a sectional view showing the heat insulating member 31.

The fixing device 7 includes: a heating roller 21; a pressing roller 27 which holds the sheet S together with the heating roller 21; a heating part 23 which heats the heating roller 21; heat insulating members 31 which are provided on the outer circumferential surfaces of the axial end portions of the heating roller 21, has a heat-resistance to a heat transmitted from the heating roller 21, and is formed in an inclined shape whose outer diameter becomes smaller toward the inside in the axial direction of the heating roller 21; and bearings 22 which supports the heating roller 21 through the heat insulating members 31. The present embodiment shows an example where the fixing device 7 is set in a posture where the pressing roller 27 is disposed below the heating roller 21, but, the fixing device 7 may be set in any posture. The right heat insulating member 31 will be described, and the left heat insulating member 31 has the same shape as the right heat insulating member 31 except that the left-and-right direction is inverse.

[Heating Roller] The heating roller 21 is a cylindrical member whose longitudinal direction is along the left-and-right direction, and is formed by a thin pipe made of aluminum alloy or stainless steel. The heating roller 21 includes a main body part 21B positioned in the center portion in the axial direction (the left-and-right direction) and shaft parts 21A positioned in the end portions in the axial direction. The main body part 21B comes into contact with the sheet S, and a release layer (not shown) made of fluorocarbon resin is formed around its outer circumferential surface. The shaft part 21A has a diameter smaller than a diameter of the main body part 21B.

[Pressing Roller] The pressing roller 27 includes a cylindrical columnar or cylindrical core bar 27C whose longitudinal direction is along the left-and-right direction, an elastic layer 27E formed around the outer circumferential surface of the core bar 27C, and a release layer (not shown) formed around the outer circumferential surface of the elastic layer 27E. The core bar 27C is made of metal such as aluminum alloy or stainless steel. The elastic layer 27E is made of silicone rubber or the like. The release layer is made of fluorocarbon resin or the like. On both right and left end portions of the core bar 27C, bearings 28 is mounted. The bearings 28 are supported by a mechanism (not shown) which can move in the upper-and-lower direction. The pressing roller 27 is biased upward by a biasing member (not shown) such as a spring through the bearings 28 with a pressing force F, and is pressed against the heating roller 21 to form a pressure region N where the heating roller 21 and the pressing roller 27 come into surface contact. A drive part 29 includes a motor and a gear train, and rotates the pressing roller 27. The heating roller 21 rotates following the pressing roller 27.

[Heating Part] The heating part 23 is a rod-like halogen heater whose longitudinal direction is along the left-and-right direction, includes a glass tube 23G and a filament 23F housed in the glass tube 23G, and is disposed inside the heating roller 21.

[Heat Insulating Member] The heat insulating member 31 includes: a cylindrical part 31C having a hollow space penetrating in the left-and-right direction; a flange part 31F provided at the right end portion of the cylindrical part 31C; and a slit 31S penetrating the cylindrical part 31C and the flange part 31F in the left-and-right direction. The heat insulating member 31 is made of resin such as PTFE (polytetrafluoroethylene) or PPS (polyphenylene sulfide), and has a heat resistance at a thermal deformation temperature of 220° C. or higher. The outer circumferential surface of the cylindrical part 31C faces the entire inner circumferential surface of the bearing 22. The outer circumferential surface of the cylindrical part 31C has an inclined shape in which the outer diameter becomes smaller toward the inside in the axial direction of the heating roller 21 over the entire axial direction. The inclined shape of the heat insulating member 31 is formed so as to have an angle at which contact with the bearing 22 is maintained by thermal expansion in the radial direction of the heat insulating member 31 even if the heat insulating member 31 shifts outward in the axial direction owing to thermal expansion in the axial direction of the heating roller 21. The inclination angle of the inclined shape with respect to the axial direction is preferably 1° or more and 2° or less.

[Bearing] The bearing 22 is, for example, a ball bearing. The fixing device 7 is housed in a housing 30, and the bearings 22 are fixed to the housing 30.

[Regulating Member] A regulating member 32 is provided on the outer circumferential surface of the heating roller 21 with a space from the axial outer surface of the heat insulating member 31 (the flange part 31F). The regulating member 32 is, for example, an annular member made of metal or resin. The regulating member 32 may be a C-ring. On the outer circumferential surface of the shaft part 21A of the heating roller 21, a circumferential groove 21C into which the regulating member 32 is fitted is formed.

Next, behavior of the heat insulating member 31 owing to heating will be described. Here, the right end portion of the heating roller 21 will be described, but the left end portion of the heating roller 21 shows the same behavior as the right end portion of the heating roller 21 except that the left-and-right direction is inverse.

Figure 7:
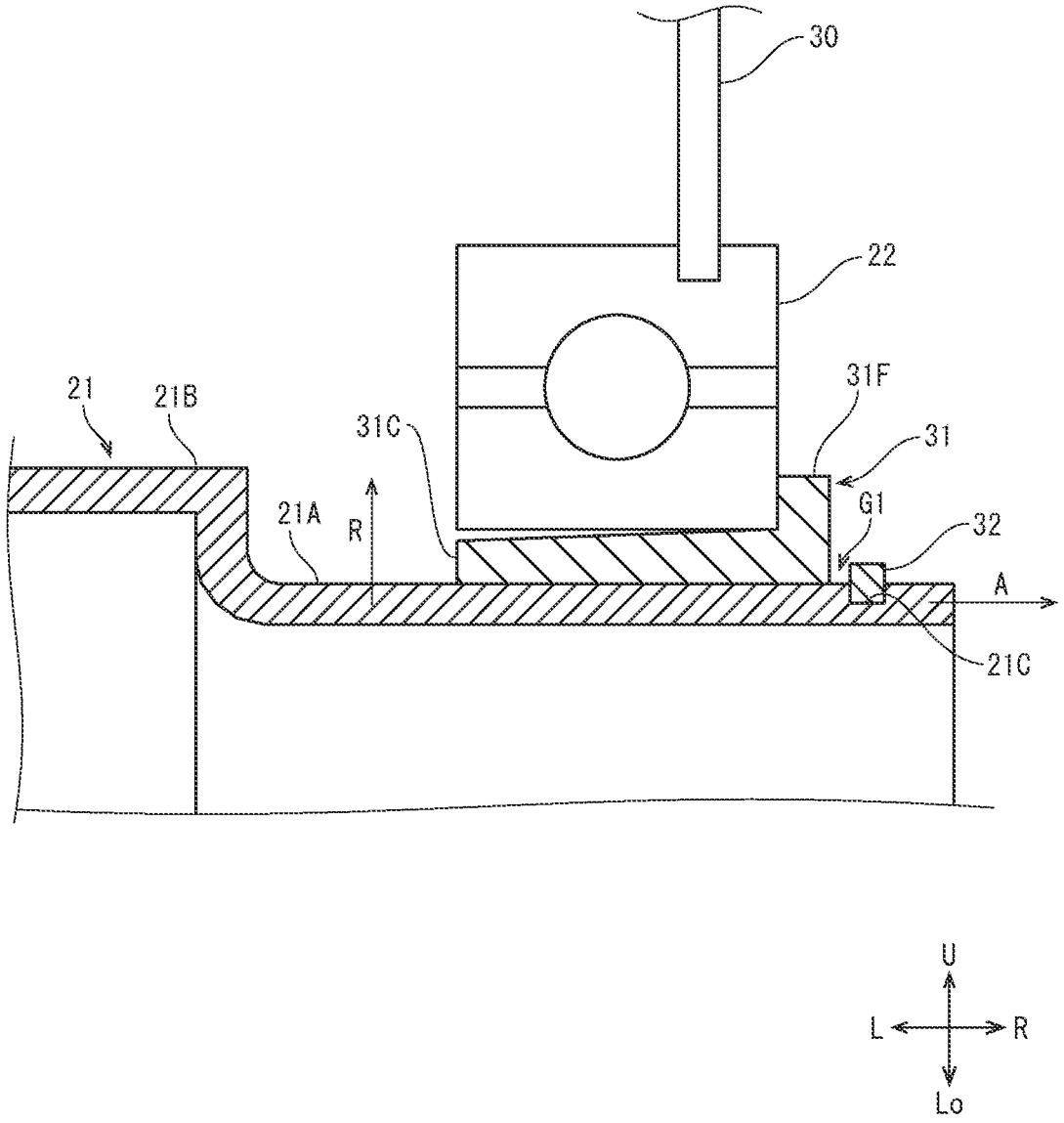
FIG. 7 is a sectional view showing a heating roller before heating.

FIG. 7 is a sectional view showing the heating roller 21 before heating. Before heating, the flange part 31F of the heat insulating member 31 is mostly closer to the bearing 22. The flange part 31F may come into contact with the bearing 22, or may not come into contact with the bearing 22. In a case where the flange part 31F does not come into contact with the bearing 22, a gap between the flange part 31F and the bearing 22 is negligibly small. Because the outer circumferential surface of the cylindrical part 31C has the inclined shape in which the outer diameter becomes small toward the inside in the axial direction, only near the flange part 31F comes into contact with the inner circumferential surface of the bearing 22. Between the flange part 31F and the regulating member 32, a gap G1 of 1 mm or less is formed.

Figure 8:
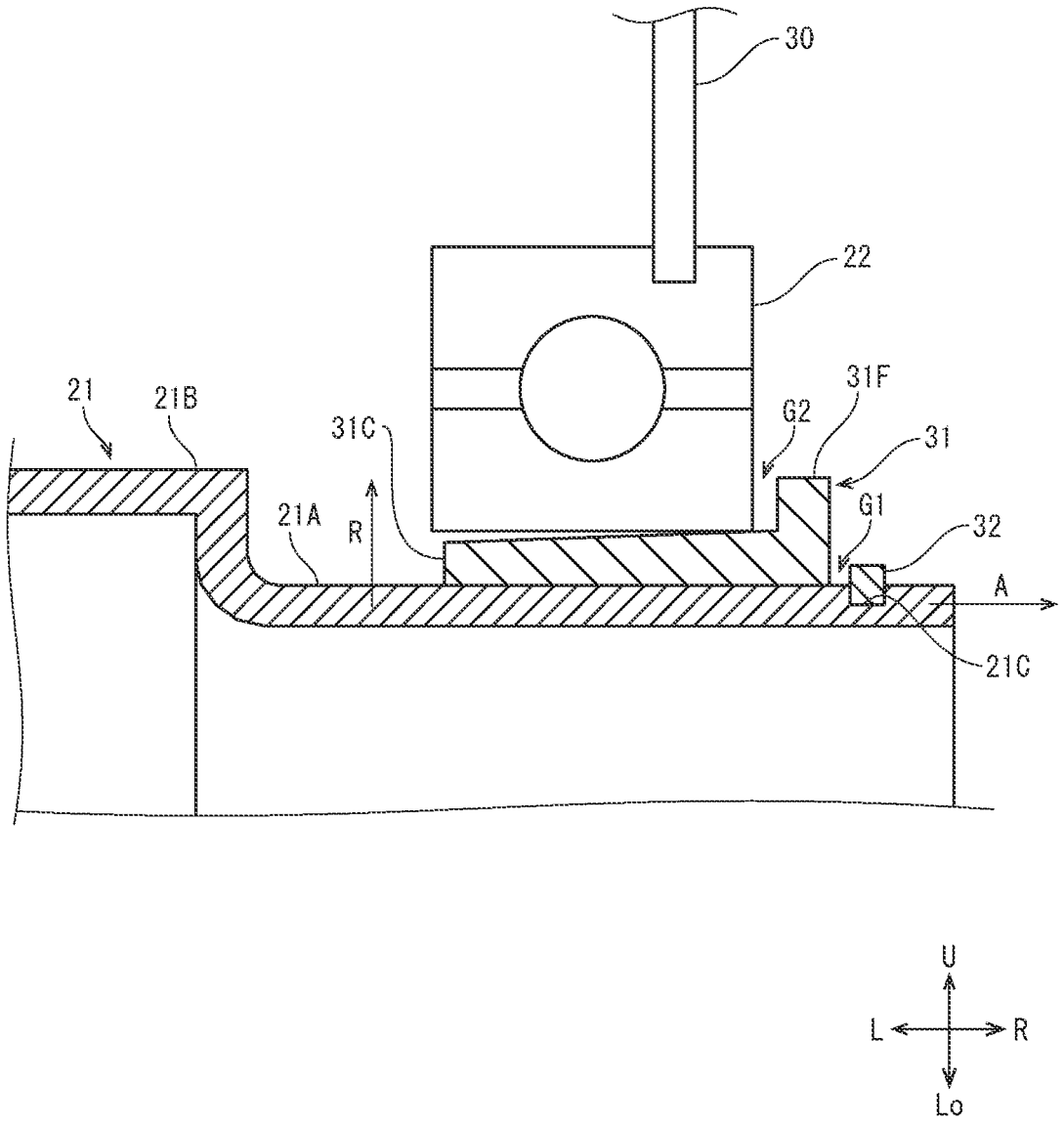
FIG. 8 is a sectional view showing the thermally expanded hearting member and heat insulating member.

FIG. 8 is a sectional view showing the thermally expanded heating roller 21 and the heat insulating member 31. Because the shaft part 21A of the heating roller 21 and the heat insulating member 31 are sifted in the axial direction A relative to the bearing 22, a gap G2 is formed between the flange part 31F and the bearing 22. The heat insulating member 31 has the inclined shape in which the outer diameter becomes smaller toward the inside in the axial direction, and the inclined shape of the heat insulating member 31 is formed so as to have an angle at which contact with the bearing 22 is maintained owing to thermal expansion in the radial direction R of the heat insulating member 31 even if the heat insulating member 31 is shifted outward in the axial direction owing to the thermal expansion in the axial direction of the heating roller 21. Therefore, a gap is not formed between the heat insulating member 31 and the bearing 22, and the rotation does not become unstable. Because the linear expansion coefficient of the resin is generally larger than that of the metal, the expansion amount of the heat insulating member 31 is larger than that of the heating roller 21. Therefore, the gap G1 between the flange part 31F and the regulating member 32 is smaller than that before the heating.

As described above, the present embodiment is configured to allow some degree of the thermal expansion of the heat insulating member 31 in the axial direction and in the radial direction, so that increase in compressive stress in the radial direction and shearing stress in the axial direction applied to the heat insulating member 31 is suppressed. As a result, it becomes possible to suppress increase of resistance to the rotation of the bearing 22 and failure such as vibration, abnormal noise, slipping and uneven wear owing to periodic deformation in the circumferential direction.

Figure 9:
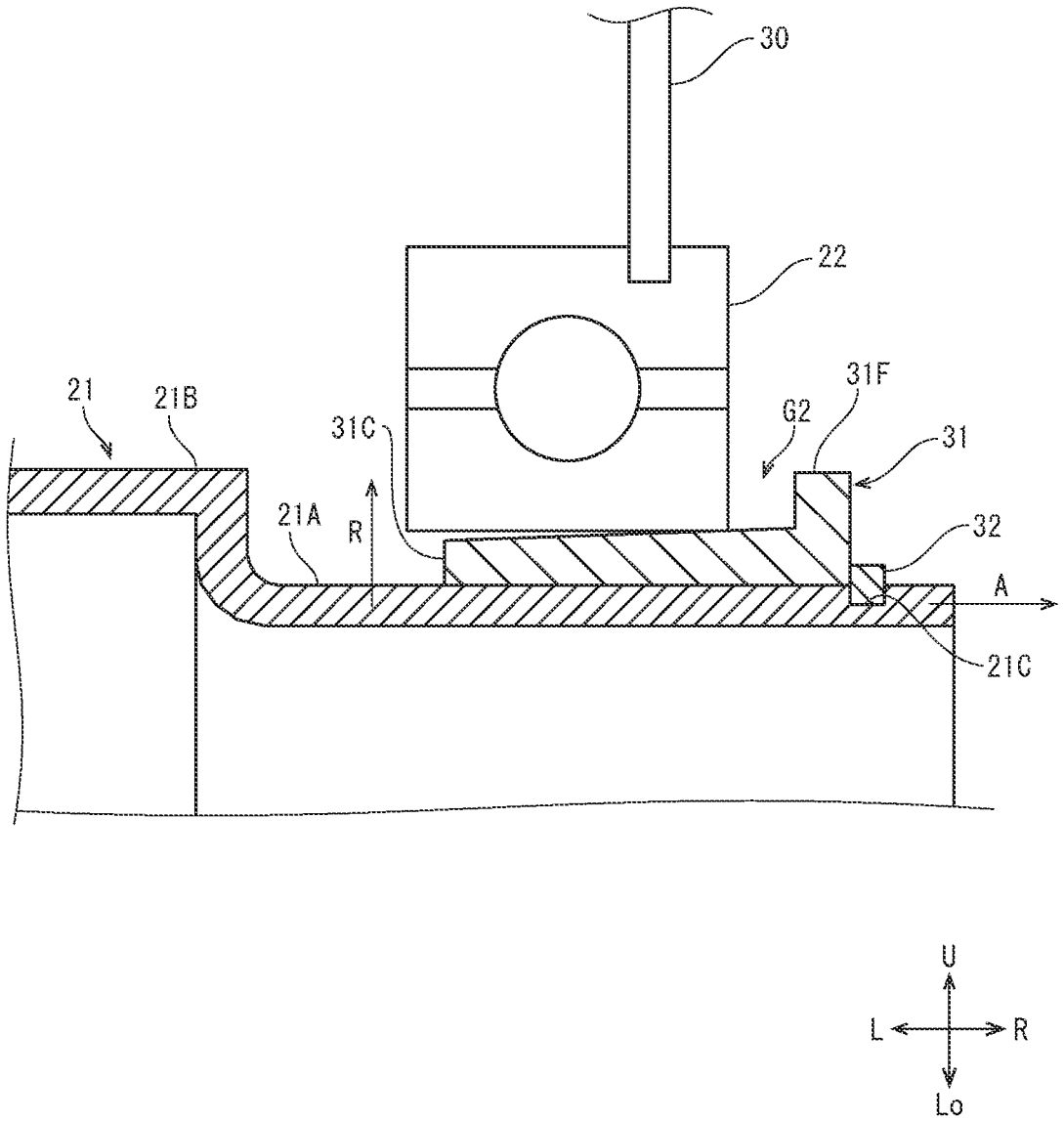
FIG. 9 is a sectional view showing a state where the thermal expansion is accelerated from the state shown in FIG. 8.
Figure 10:
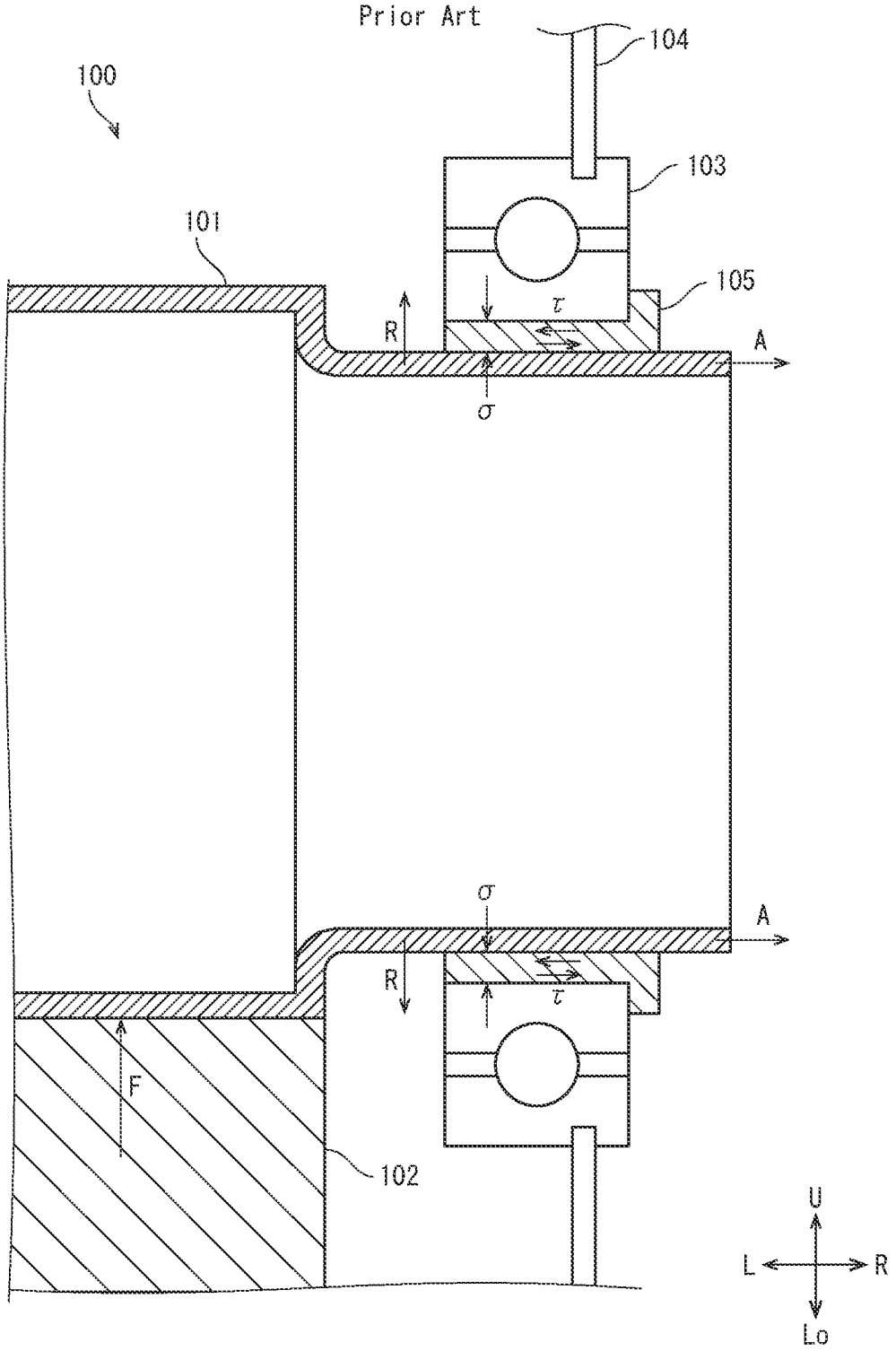
FIG. 10 Prior Art
FIG. 10 is a sectional view showing an axial end portion of the heating roller in a conventional fixing device.
Figure 11:
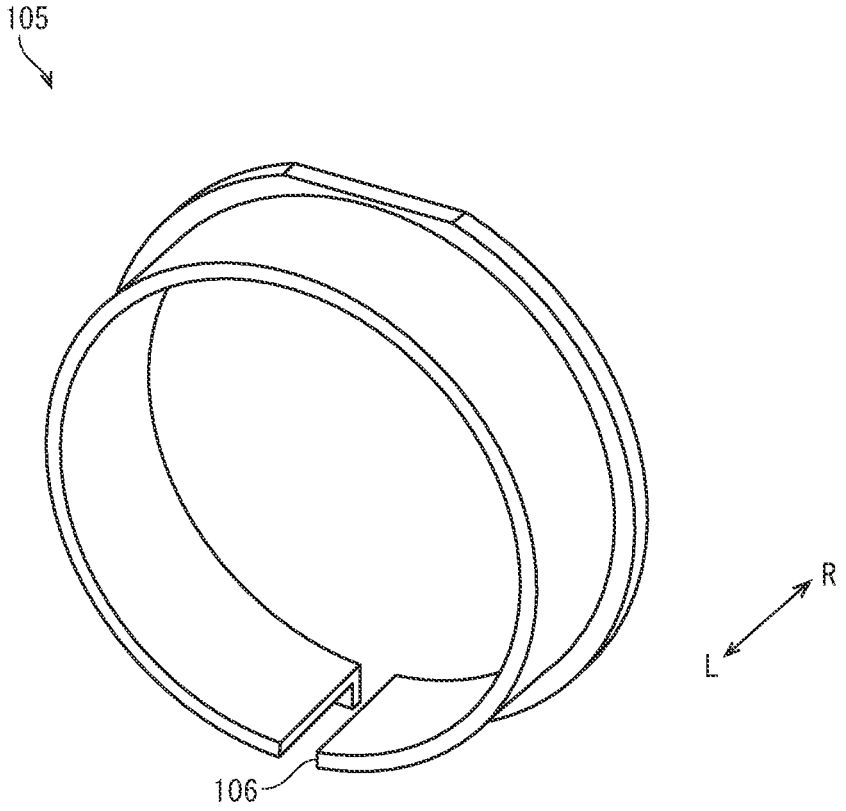
FIG. 11 Prior Art
FIG. 11 is a perspective view showing a conventional heat insulating member.

FIG. 9 is a sectional view showing a state where the thermal expansion is accelerated from the state shown in FIG. 8. Because the shaft part 21A of the heating roller 21 and the heat insulating member 31 is more sifted rightward relative to the bearing 22, the gap G2 between the flange part 31F and the bearing 22 becomes larger than that shown in FIG. 8. The heat insulating member 31 further expands in the radial direction, and the contact between the heat insulating member 31 and the bearing 22 is maintained. Further, the gap G1 between the flange part 31F and the regulating member 32 is lost, and the flange part 31F comes into contact with the regulating member 32. Accordingly, even if the thermal expansion is further accelerated after that, it becomes possible to prevent the formation of the gap between the heat insulating member 31 and the bearing 22 and the unstable rotation.

According to the fixing device 7 according to the present embodiment described above, the heat insulating member 31 having the inclined shape in which the outer diameter becomes small toward the inside in the axial direction of the heating roller 21 is provided, so that it becomes possible to suppress the failure owing to the thermal expansion of the heating roller 21 and the heat insulating member 31 without making the structure complicated.

Furthermore, according to the fixing device 7 according to the present embodiment, the inclined shape of the heat insulating member 31 is formed so as to have an angle at which the contact with the bearing 22 is maintained owing to the thermal expansion in the radial direction of the heat insulating member 31 even if the heat insulating member 31 is shifted outward in the axial direction owing to the thermal expansion in the axial direction of the heating roller 21, so that it becomes possible to prevent the formation of the gap between the heat insulating member 31 and the bearing 22 and the unstable rotation.

Furthermore, according to the fixing device 7 according to the present embodiment, the regulating member 32 provided on the outer circumferential surface of the heating roller 21 with a distance from the axial outer surface of the heat insulating member 31 is provided, so that the heat insulating member 31 is prevented from being excessively shifted in the axial direction. Therefore, it becomes possible to prevent the formation of the gap between the heat insulating member 31 and the bearing 22 and the unstable rotation.

Furthermore, according to the fixing device 7 according to the present embodiment, the heat insulating member 31 has the flange part 31F facing the axial outer surface of the bearing 22, so that it is possible to prevent the heat insulating member 31 from entering inside in the axial direction when the temperature decreases.

Furthermore, according to the fixing device 7 according to the present embodiment, the heat insulating member 31 includes the slit 31S penetrating in the axial direction. Although the slit 31S has an effect of absorbing the thermal expansion in the circumferential direction, the failure such as vibration, abnormal noise, slipping, uneven wear due to periodic deformation in the circumferential direction of the heat insulating member 31 are likely to occur. Therefore, the present disclosure is suitable for this configuration.

The above embodiment may be modified as follows.

The above embodiment shows an example in which the outer circumferential surface of the cylindrical part 31C has the inclined shape over the entire area in the axial direction, but a part of the outer circumferential surface of the cylindrical part 31C including the outer end portion in the axial direction may have the inclined shape.

The above embodiment shows an example in which the heat insulating member 31 is provided with the regulating member 32, but the regulating member 32 may not be provided.

The above embodiment shows an example in which the flange part 31F is provided in the heat insulating member 31, but instead of the flange part 31F, a member similar to the regulating member 32 may be provided on the outer circumferential surface of the heating roller 21 so as to come into contact with the axial inner surface of the heat insulating member 31.

The above embodiment shown an example in which the heat insulating member 31 is provided with the slit 31S, but the present disclosure may be applied to the fixing device 7 in which the heat insulating member 31 is not provided with the slit 31S.

The above embodiment shows an example in which the diameter of the shaft part 21A is smaller than that of the main body part 21B, but the present disclosure may be applied to the fixing device 7 in which the diameter of the shaft part 21A is the same as that of the main body part 21B.

The above embodiment shows an example in which the heating part 23 is a halogen heater, but the heating part 23 may be an induction heater or the like.

Although one aspect of the embodiment according to the present disclosure is described, the present disclosure is not limited to the above embodiment. The present disclosure may be modified, substituted, or modified in various ways without departing from the spirit of the technical idea.

The invention claimed is:

1. A fixing device comprising:

a heating roller;

a pressing roller holding a sheet with the heating roller;

a heating part which heats the heating roller;

a heat insulating member fitted on an end portion in an axial direction of the heating roller, having a heat-resistance to heat applied from the heating roller and having an inclined shape in which an outer diameter becomes small toward an inside in the axial direction of the heating roller; and a bearing by which the heating roller is supported through the heat insulating member wherein an inclination angle of the inclined shape to the axial direction is 1° or more and 2° or less.

2. The fixing device according to claim 1, wherein the inclined shape of the heat insulating member is formed so as to have an angle at which contact with the bearing is maintained owing to thermal expansion in a radial direction of the heat insulating member even if the heat insulating member is shifted outward in the axial direction owing to thermal expansion in the axial direction of the heating roller.

3. The fixing device according to claim 1, further comprising a regulating member provided on an outer circumferential surface of the heating roller with a gap from an outer surface in the axial direction of the heat insulating member.

4. The fixing device according to claim 1, wherein the heat insulating member has a flange part facing an outer surface in the axial direction of the bearing.

5. The fixing device according to claim 1, wherein the heat insulating member has a slit penetrating in the axial direction.

6. The fixing device according to claim 1, wherein the heating roller is formed in a cylindrical shape, has a main body part positioned in a center portion in the axial direction and shaft parts positioned in end portions in the axial direction and having a diameter smaller than a diameter of the main body part, and the heat insulating member is fitted on the shaft part.

7. The fixing device according to claim 1, wherein a heat expansion coefficient of the heat insulating member is larger than a heat expansion coefficient of the heating roller.

8. An image forming apparatus comprising:

an image forming device which forms a toner image on a sheet; and the fixing device according to claim 1, which fixes the toner image on the sheet.

* * * * *